United States Patent [19]

Pelletier

[11] 4,302,800

[45] Nov. 24, 1981

[54] LAMP MEANS WITH ORIENTABLE MODULAR ELEMENTS

[76] Inventor: Jean F. S. Pelletier, 37 avenue de la Liberté, 95600 Eaubonne, France

[21] Appl. No.: 83,369

[22] Filed: Oct. 10, 1979

[30] Foreign Application Priority Data

Oct. 10, 1978 [FR] France ..... 78 28826

[51] Int. Cl.[3] ..... F21V 21/14

[52] U.S. Cl. ..... 362/250; 362/252; 362/287; 362/368

[58] Field of Search ..... 362/250, 252, 287, 368

[56] References Cited

U.S. PATENT DOCUMENTS 4,190,881 2/1980 Drost et al. ..... 362/250

*Primary Examiner*—Stephen J. Lechert, Jr.

*Attorney, Agent, or Firm*—Armstrong, Nikaido, Marmelstein & Kubovcik

[57] ABSTRACT

Lamp apparatus consisting of assembled polyhedric modules, each module comprising a shaped, hollow polyhedron and a light mounted in the polyhedron. Each polyhedron has sides with circular ribs extending therefrom. The assembly of two consecutive modules is achieved by nesting the circular complementary ribs provided on the sides to be assembled of those two modules. The complementary parts are coaxial and thereby permit each module to rotate independently about the axis.

6 Claims, 6 Drawing Figures

LAMP MEANS WITH ORIENTABLE MODULAR ELEMENTS

The invention relates to lamps with assembled modular elements, in particular lighting strips, or similar, which can easily be taken apart thereafter. The recovered elements can be used in other constructions without requiring alterations or special work. The external shape of the elements may vary, but as a rule it is polyhedric, and more generally it is parallelipipedic.

The elements preferably are made of molded plastic and each is hollow and open at two opposite sides. Some, or all of the closed sides (hereafter called the lateral sides) comprise assembly means permitting to join a variable number of elements to form a light strip, stage lights, or another lamp of larger or lesser size.

The invention relates to lamps achieved by means of such elements. The inside of said elements is designed to house a single bulb in most cases. Such strips may be used in ballrooms and be connected to means modulating the light of particular bulbs as a function of the music.

Under the invention, the lamps consist of assembled modular elements characterized in that the assembly of two consecutive modules is achieved by nesting circular and complementary parts on the sides to be joined in these two modules, the complementary parts being coaxial, thereby allowing independent rotation by each module about this axis. Preferably each module is parallelipipedic; each lateral side of an element comprises sets of circular concentric ribs, which are identical on both sides, and for instance consecutive, the radii of the circles on those two other sides differing (being larger smaller) by the rib thickness, so designed that the ribs of one side of the module can nest along the ribs of the complementary side of another module. Assembly takes place by pushing the two complementary sides toward each other, and the friction between the ribs alongside each other suffices to lock together two consecutive modules.

Because the ribs are circular, two or more consecutive modules can be made to rotate about an axis which is common to said ribs. Therefore each module can be oriented independently of the neighboring module(s). The friction of the ribs, one along the other, constitutes a braking action which can easily be overcome manually to achieve rotation. This braking furthermore ensures that the module shall stay in the desired position.

The circular ribs permitting rotation define a central area seating another circular rib coaxial with the others but of a height at most half that of the main ribs. This inside rib is used to position and keep in place the pivot of a bail or other support means. The diameter of this central rib is the same on the four lateral sides.

All these ribs constituting the assembly means are directly obtained by molding and no other means are required for assembly, and for fastening any bail, and the independent orientation of each module. It is easily seen that the cost of these modules may be equivalent to other models already marketed while offering the advantage of orientation and combination at will.

Among the lighting so obtained using said elements are strips and stage lights formed by assembling several modular elements in a row, for instance a horizontal row, with the latitude to control the light beam from each module in elevation. This control is achieved by merely rotating each module.

Such a set may be put on the ground or suspended from a bail of which the two pivots penetrate the end ribs of modules at the beginning and end of the row.

Accordingly the modules of the invention also allow implementing lamps of abstract and/or tentacular shapes.

A module located between two other horizontal modules can also be located between two modules arranged along a vertical line. In this case the lamp assumes the shape of "+". The light beams from the horizontal strip can be oriented vertically while the light beams from the upper and lower modules can be oriented horizontally. Other modules can be added and more complex arrangement can be obtained, with multiple orientation of the light beams.

To better understand the invention, illustrative embodiments are discussed below in relation to the attached drawings.

Figure 1:
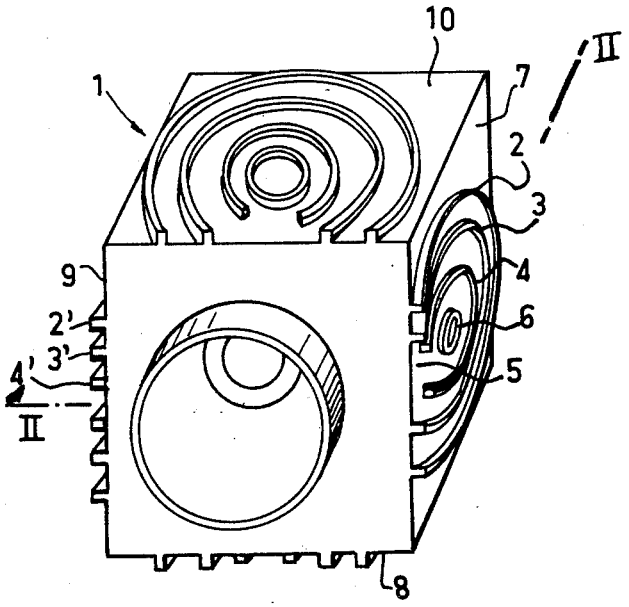
FIG. 1 is a perspective of one element.
Figure 3:
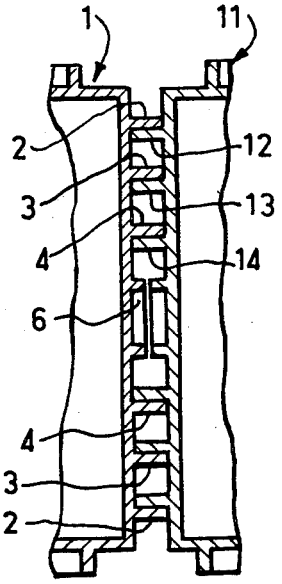
FIG. 3 is a cross-section of the assembly.

FIG. 1 shows the side 7 of a module comprising circular ribs 2,3,4 which are open at 5 and with a fully circular rib 6 at the center. The diameters of the three large ribs is the same on two consecutive sides 10 and 7, whereas on the other two sides 8,9 the diameters are larger (or less) by two rib thicknesses so that the two modules 1 and 11 suitably placed next to each other juxtapose their ribs (2 and 12, 3 and 13, 4 and 14), the inside circumference (height) of one of them resting with a slight pressure on the outside circumference of the corresponding rib of the other module. The cross-section of each rib is slightly conical to facilitate nesting (FIG. 3).

Figure 2:
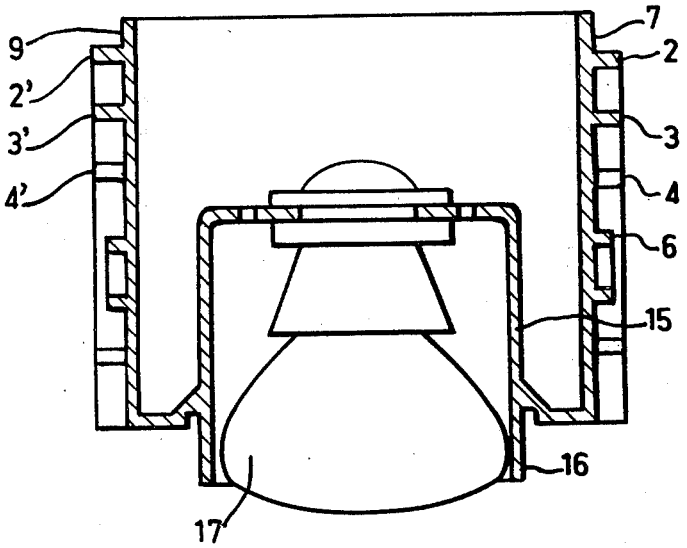
FIG. 2 is a section along II—II of FIG. 1.

FIG. 2 shows the offset between the ribs (2–2', 3–3', 4–4') with respect the two sides 7 and 9 of the same element and opposite to each other. This element is in the general shape of a hollow cube with a screen 15 perforated at its center to allow seating the bulb 17. Advantageously a collar 16 extends the bulb housing to protect said bulb.

Figure 4:
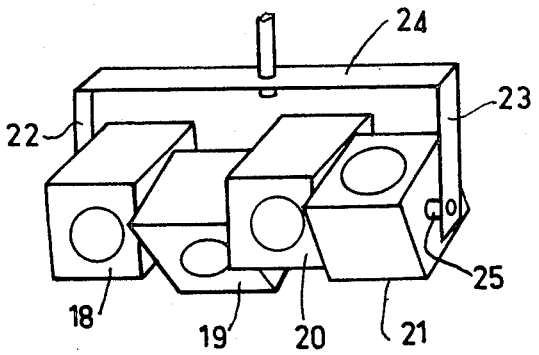
FIG. 4 shows a strip of modules mounted in a bail.

FIG. 4 shows a strip formed by elements 18 through 21 and fastened between the arms 22–23 of bail 24. The pivot 25 of each arm enters the seat defined by the central circular rib of the corresponding side. Each element can be oriented independently from its neighbor(s).

Figure 5:
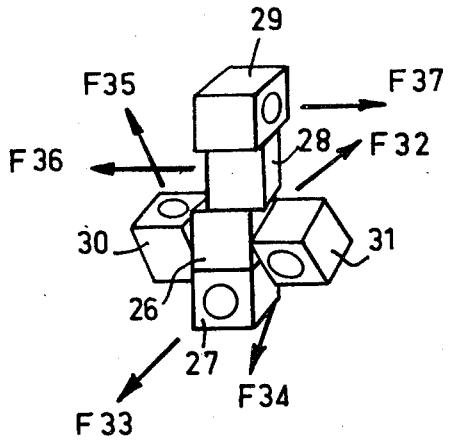
FIG. 5 shows a complex set of modules.

FIG. 5 shows an assembly of elements 26 through 31. The arrows indicate the various directions of the light projections. It will be noted that it is easy to obtain light beams directed to the rear (F 32), to the front (F33), to the bottom (F 34), upward (F 35), to the left (F 36) and to the right (F37).

The shapes of the objects shown are not restrictive, and many variations are possible without thereby transcending the scope of the invention.

Figure 6:
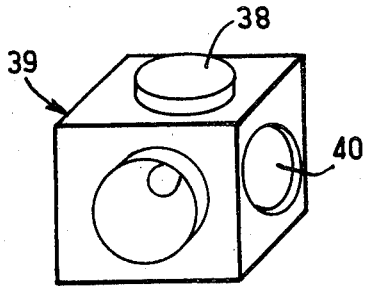
FIG. 6 is a perspective of a simplified element.

For instance a simplified element as shown in FIG. 6 may be constructed.

A circular shoulder 38 of a module 39 can engage a complementary recess provided on the side of another module which is to be assembled, said recess being identical with that on the next side of module 39 and denoted by 40.

I claim:

1. Lamp means consisting of assembled polyhedric modules, each module comprising a shaped, hollow polyhedron and light means mounted in said polyhedron, each polyhedron having sides with circular ribs extending therefrom whereby the assembly of two consecutive modules is achieved by nesting said circular complementary ribs provided on the sides to be assembled of these two modules, the complementary ribs being coaxial and thereby permitting each module to rotate independently about said axis.

2. Lamp means per claim 1, wherein each module is parallelipipedic and that each lateral side comprises sets of concentric circular ribs so arranged that, as regards two opposite sides, the centers of the circles so defined are coaxial.

3. Lamp means per claim 2, wherein the circular ribs of the two opposite sides of a module have different diameters, with the corresponding ribs differing in diameters approximately by the thickness of one rib, one of the opposite sides being termed complementary to the other.

4. Lamp means per any one of claims 1–3, wherein a supplementary circular rib is provided at the center of nesting circular ribs, the height of said supplementary rib being half the height of the nexting ribs and being of the same diameter on all sides and concentrical with the other ribs.

5. Lamp means per claim 4, further comprising a bail having arms which are each provided with a pivot embedded into the central rib of an end side of a strip of modules.

6. Lamp means per claim 4, wherein one or several modules of a strip being provided at the upper and lower lateral sides with supplementary modules, the modules of a horizontal strip being vertically orientable while the modules nesting along vertical strips are horizontally orientable.

* * * * *